US006054655A

United States Patent [19]

Rudolph et al.

[11] Patent Number: 6,054,655

[45] Date of Patent: Apr. 25, 2000

[54] POWER WINDOW SWITCH

[75] Inventors: Gerd Rudolph, Aspisheim; Norbert Swidersky, Heldesheim, both of Germany

[73] Assignee: Eaton Corporation, Cleveland, Ohio

[21] Appl. No.: 09/299,116

[22] Filed: Apr. 23, 1999

[30] Foreign Application Priority Data

May 11, 1998 [DE] Germany ..... 198 20 998
Nov. 21, 1998 [DE] Germany ..... 198 53 818

[51] Int. Cl.[7] ..... H01H 21/84

[52] U.S. Cl. ..... 200/16 R; 200/1 B; 200/5 R; 200/339

[58] Field of Search ..... 200/1 R, 1 B, 200/4, 5 R, 6 R, 6 B, 16 R, 17 R, 18, 553, 557, 558, 572, 517, 339

[56] References Cited

U.S. PATENT DOCUMENTS 5,412,164 5/1995 Conway et al. ..... 200/1 B
5,414,231 5/1995 Sato et al. ..... 200/1 R
5,468,926 11/1995 Sato ..... 200/558
5,647,478 7/1997 Hirai ..... 200/303
5,693,920 12/1997 Maeda ..... 200/1 B
5,783,785 7/1998 Furukawa ..... 200/1 B
5,920,042 7/1999 Gotoh ..... 200/5 R

FOREIGN PATENT DOCUMENTS 44 31 061 9/1994 Germany ..... H01H 25/06
195 37 296 10/1995 Germany ..... H01H 23/28

*Primary Examiner*—Michael Friedhofer
*Attorney, Agent, or Firm*—Roger A. Johnston

[57] ABSTRACT

A power window switch (1) for a motor vehicle comprises an actuation element (2) which is pivotally supported in a housing (6) and actuates switch contacts (57) by means of a corresponding sliding contact element (35), whereby said switch contacts are associated with connector contacts (53). In the pushing direction for the downward motion of the window, as well as in the pulling direction for the upward motion of the window, the actuation element (2) is respectively associated with a two-step pivoting motion (19), whereby the actuation element (2) acts on deflecting means (38, 78) to effect a linear back and forth motion of the sliding contact element (35), which successively actuates two switch contacts (57) of a switch matrix (49).

3 Claims, 7 Drawing Sheets

POWER WINDOW SWITCH

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The invention herein relates to a motor vehicle power window switch of the type in a housing and having pivotally supported actuation element, which actuates switch contacts by means of a corresponding sliding contact element associated with connector contacts.

DE 44 31 061 discloses a pop-up sliding switch, in particular, for a pop-up sliding roof of a motor vehicle. The housing, which comprises connector contacts, has an actuation button that can be pivoted or slid back and forth in neutral position, whereby a lever acting on a sliding contact element is mounted to the actuation button. A rotary switch element is supported pivotally on the sliding contact element, whereby the lever of the actuation button comes into movable engagement with the rotary switch element. Both switch elements return automatically to their home positions and reset the actuation button connected therewith to its home position.

The reset system consists of a guide tube, which supports spring-biased pressure sleeves and is mounted to the rotary switch element, and of two projections, which adjoin a base and extend into the housing and bear two recessed reset pyramids. Due to the pressure exerted by a pressure spring, the pressure sleeves are pushed in an outward direction against the recessed reset pyramids in the projections; therefore, once the actuation button is released, the reset system and thus the switch elements assume their zero position. By pivoting or sliding the actuation button, the contact spring areas associated with the rotary and/or sliding contact elements are brought into abutment with a punch grid recessed in the base. The dimensions of these contact spring areas are such that a larger number of current paths can be implemented. The purpose of the pop-up sliding switch is the control of different motors, which can rotate clockwise or counterclockwise.

Furthermore, DE 195 37 296 A1 discloses a rocker switch device for a two-stage actuation lifting cycle, said device being part of an actuation unit for automobile power windows and comprising one pair of actuation plates below a longitudinal bisectrix of a rocker bar. These actuation plates are coupled by means of elastic connecting arms and, form an actuation element.

Each actuation plate acts on two pressure switches, which consist of a switch matrix having hollow projections with inset contact elements and a base plate with stationary contact elements associated with the movable contact elements. When the rocker is actuated, the latter pivots about the support axle journal of a housing so that the actuated side of the rocker bar is moved downward. This downward motion is transmitted over the corresponding actuation plate to the hollow switch matrix projections located underneath on the right and left sides. These projections are arranged in such a manner that, due to the influence of different torques, first the left projection is deformed; and, due to the contact of the contact elements located there, an electric circuit is closed. Continued downward actuation of the rocker bar will also cause the right projection to be pushed downward by the actuation plate and close another electric circuit. When the rocker bar is released, it is reset and the closed electric circuits are interrupted.

The use of a rocker switch device for the control of power window switches involves the inherent risk of inadvertent actuation. The closing of the window due to inadvertent pressing of the rocker bar is disadvantageous because possible bodily injury could be caused to a person who, for example, might have his/her hand or his/her head in the closing range of the window.

BRIEF SUMMARY OF THE INVENTION

The present invention solves the problem of providing a power switch, in particular a power window switch for a motor vehicle, of the above-described type, whereby the switch prevents the inadvertent closing of the window, permits switch actuation by touch and is characterized by a compact design with the smallest possible number of components, as well as being reliable in its function.

In accordance with the present invention, the actuation element is associated in a pushing direction for the downward motion of the window and in a pulling direction for the upward motion of the window, respectively, with a two-stage pivoting motion. The actuation element acts on deflecting means to effect a linear back-and-forth motion of the sliding contact element, which successively actuates two switch contacts of a switch matrix in each direction.

The inadvertent closing of the window is prevented because the actuation of the actuation element in pulling direction must be carried out consciously. Furthermore, the successive stress on two switch contacts of one switch matrix permits the actuation of the switch by touch. Variations for switch actuation by touch can be achieved by appropriate configuration of the mechanical resistance of the switch matrix, i.e., as regards rigidity and design of the matrix. The actuation element acts on deflecting means to achieve the linear motion of the switch element and thereby permits a compact design of the power window switch.

In accordance with an advantageous embodiment of the present invention, the deflecting means comprise the free, T-shaped end of a crosspiece of the actuation element and one sliding contact element opening, into which is engaged the free end of the crosspiece. As a result of this, no additional components are required for allowing the appropriate deflection of the pivoting motion of the actuation element into a linear motion of the sliding contact element.

In accordance with an alternative embodiment of the present invention, the deflecting means comprises, pivotally supported in the housing, a two-arm deflecting lever, whereby one of its arms having a T-shaped end comes into engagement with an opening of the sliding contact element; and, its other arm is provided with horizontally opposed pins, around which extends a fork being an integral part of the actuation element. The use of the deflecting lever permits a variation of the pivoting motion of the actuation element, thereby substantially maintaining the design of the power window switch. As a result of this, the manufacturer can produce a large number of basic components and needs only adapt certain individual components for specific application requirements.

Preferably, the deflecting lever comprises two horizontally opposed support pins, which come into engagement with corresponding openings of the housing. Inasmuch as the plastic deflecting lever, as well as the housing, are produced by injection-molding, the support can be accomplished without special manufacturing or assembly efforts.

During the pivoting motion of the actuation element the deflecting lever transmits forces to the sliding contact element, which, therefore, must exhibit sufficient stability. The deflecting lever preferably has a larger cross-section in the area of the support pin, and the arm of the deflecting lever associated with the actuation element is provided with reinforcing ribs.

In order to aid the transmission of power during the pivoting motion of the actuation element, preferably the arm of the deflecting lever facing the actuation element has on its front end a cutout with a resilient tongue adjoining its base, whereby the tongue is held on its end side by the actuation element in such a manner that there is no play. Furthermore, the smooth support of the tongue by the actuation element is experienced (by the operator) as a positive switching operation because the actuation element is not subject to play at this point. The spring effect of the tongue can be adjusted by the depth of the cutout recessed in the arm of the deflecting lever and can be varied by relatively simple retooling.

Preferably, the T-shaped end of the crosspiece or the deflecting lever has a circular or semi-circular cross-section; and, the opening provided on a wider end of the sliding contact element is rectangular. This creates the necessary freedom of movement.

In order to allow an easy engagement of the crosspiece or the deflecting lever in the opening of the sliding contact element and to prevent the crosspiece or the deflecting lever from sliding out of the opening of the sliding contact element into one of the end positions of the sliding contact element, preferably two opposing reinforcing ribs are provided. These ribs project slightly into the opening and accommodate between them the T-shaped end of the crosspiece or the deflecting lever.

The longitudinal sides of the opening are provided with two exterior opposing spring arms, which, being pretensioned, abut against the T-shaped end of the crosspiece or the deflecting lever. The crosspiece of the actuation element or the deflecting lever is supported without play in the opening of the sliding contact element and the touch of the switch is perceived (by the operator) in a positive manner because no unnecessary play need be overcome during the pivoting motion of the actuation element.

In accordance with a modification of the present invention the sliding contact element has essentially the shape of a plate supported between stationary guide bars in such a manner that it can be moved back and forth in horizontal direction. Furthermore, the sliding contact element has reinforcing ribs on its upper side. In addition, the lower side of the sliding contact element rests on a connecting bracket of two switch matrices; and, the upper side of the sliding contact element is associated with clip noses of stationary clip arms in such a manner that they have play. As a result of this configuration of the support, the use of additional individual components is not necessary.

Guide bars and clip arms are parts of a base and are produced together with the base by injection-molding. Friction losses caused by the longitudinal shift of the sliding contact element are minimized due to the almost point-like support of the sliding contact element on the connecting bracket and due to the upper limits created by the clip noses of the clip arms and the reinforcing ribs abutting against the housing. Furthermore, the assembly of the sliding contact element is accomplished by simple clip insertion. The reinforcing ribs of the sliding contact element counteract a bending of the sliding contact element.

The sliding contact element is provided on its lower side with two actuation extensions, which are offset from the center of the longitudinal axis of the element and at distances from each other; and, the actuation extensions act respectively on the switch contacts of the corresponding switch matrix. The sliding contact element, with the adjoining actuation extensions, is produced in one manufacturing step and therefore in a cost-effective manner.

Preferably, each switch matrix comprises two switch contacts in adjacent domes at a distance from each other, whereby the upper parts of the domes are covered by one common actuation plate. As a result of this arrangement, the sliding contact element requires only one actuation extension for the actuation of each switch matrix because the extension, by means of the actuation plate, acts in an eccentric manner on the switch contacts; and, depending on the path, first actuates one of the switch contacts and subsequently both switch contacts by depressing the domes. The domes are relatively close to each other, which is why the switch design is narrow; also, they are configured in such a manner that the perception of the switching operation by touch is ensured when the domes are collapsed during their actuation.

In order to achieve a short switch design and minimal assembly effort, the connector contacts associated with the switch contacts are recessed in a rib of the base of the housing and disposed perpendicular to the longitudinal axis of the sliding contact element. In addition, a switch matrix with two horizontally arranged switch contacts is provided on one side of the rib of the base. The connector contacts are preferably embedded by spray-coating.

In order to protect the connector contacts outside the base from damage and to prevent errors when the switches are connected, the connector contacts are provided with a connector collar configured in such a manner that it acts as a connecting code.

In order to cover the installation opening of the switch in the motor vehicle completely and achieve an ergonomic switch actuation, the upper side of the housing is covered by a shield with a recessed well, which comes into engagement with the actuation element. This shield can be mounted to the housing by means of detachable connecting elements or molded to the housing. The well is provided in such a manner that the actuation element of the switch can be accessed easily from behind to actuate the actuation element in a pulling direction. Furthermore, in order to simplify the switch assembly in the motor vehicle, a retaining spring is provided for each on the front and rear sides of the housing. These retaining springs extend around the upper edge of an installation opening and, in so doing, ensure the secure installation of the switch.

BRIEF DESCRIPTION OF THE DRAWINGS

The invention herein will be explained in detail with the use of an example of embodiment and with reference to drawings.

DETAILED DESCRIPTION OF THE INVENTION

Figure 1:
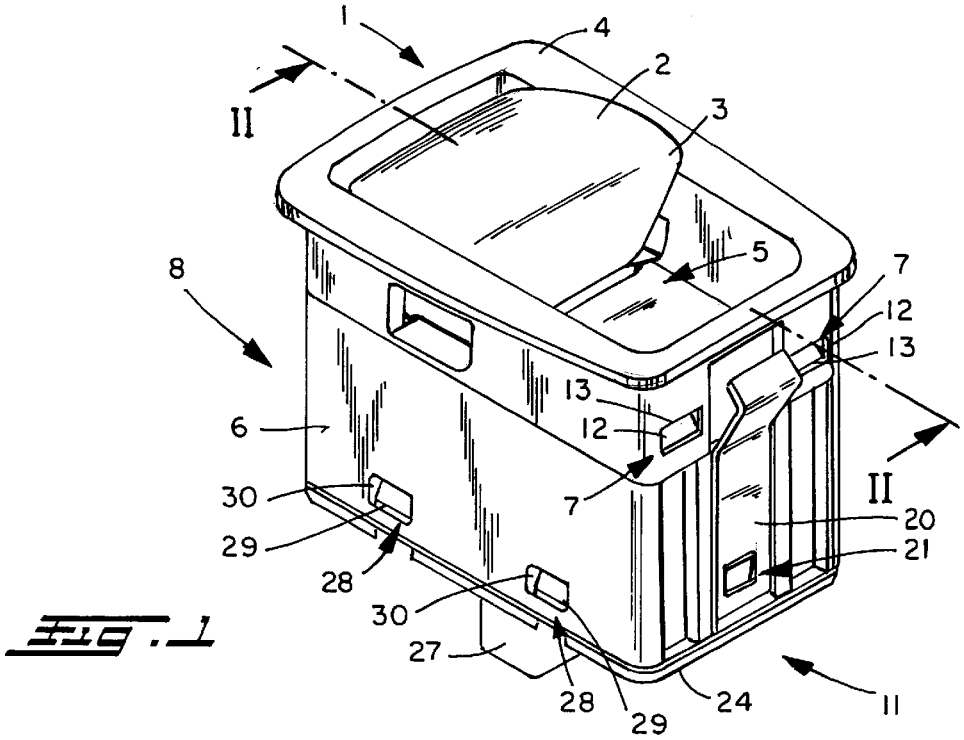
FIG. 1 is a perspective view of a first form of embodiment of the inventive power window switch.

In a first embodiment a power window switch indicated generally at 1 has in its upper portion an actuation element 2 with an upper edge 3 projecting beyond a shield 4 and engaging in a well indicated generally at 5 recessed in shield 4. Actuation element 2 is configured in such a manner that it can be accessed by reaching behind into well 5. The upper edge of shield 4 projects on all sides beyond housing 6 and covers a not illustrated motor vehicle installation opening that is slightly larger than housing 6. Housing 6 and shield 4 are connected by means of clip connections indicated generally at 7. In order to achieve these clip connections 7, there is, in the area of front side 8 of housing 6 on an upwardly projecting adjoining collar 9, a clip nose 10 that is overlapped in the rear by the lower edge of shield 4 (see FIG. 2).

Furthermore, in the area of the rear side indicated generally at 11 of housing 6, there are two clip arms 12 at a distance from each other, which clip arms come into engagement with corresponding clip openings 13 of shield 4. Collar 9 has in the upper area of its lateral surfaces indicated generally at 14 (see FIG. 3) at a clip nose 15 each, whereby said clip noses form clip connections indicated generally at 17 with lateral circular clip openings 16 of actuation element 2. Clip connections 17 represent an axis of rotation 18, about which actuation element 2 carries out a pivoting motion as indicated by the arrows at 19 in FIG. 2.

Figure 2:
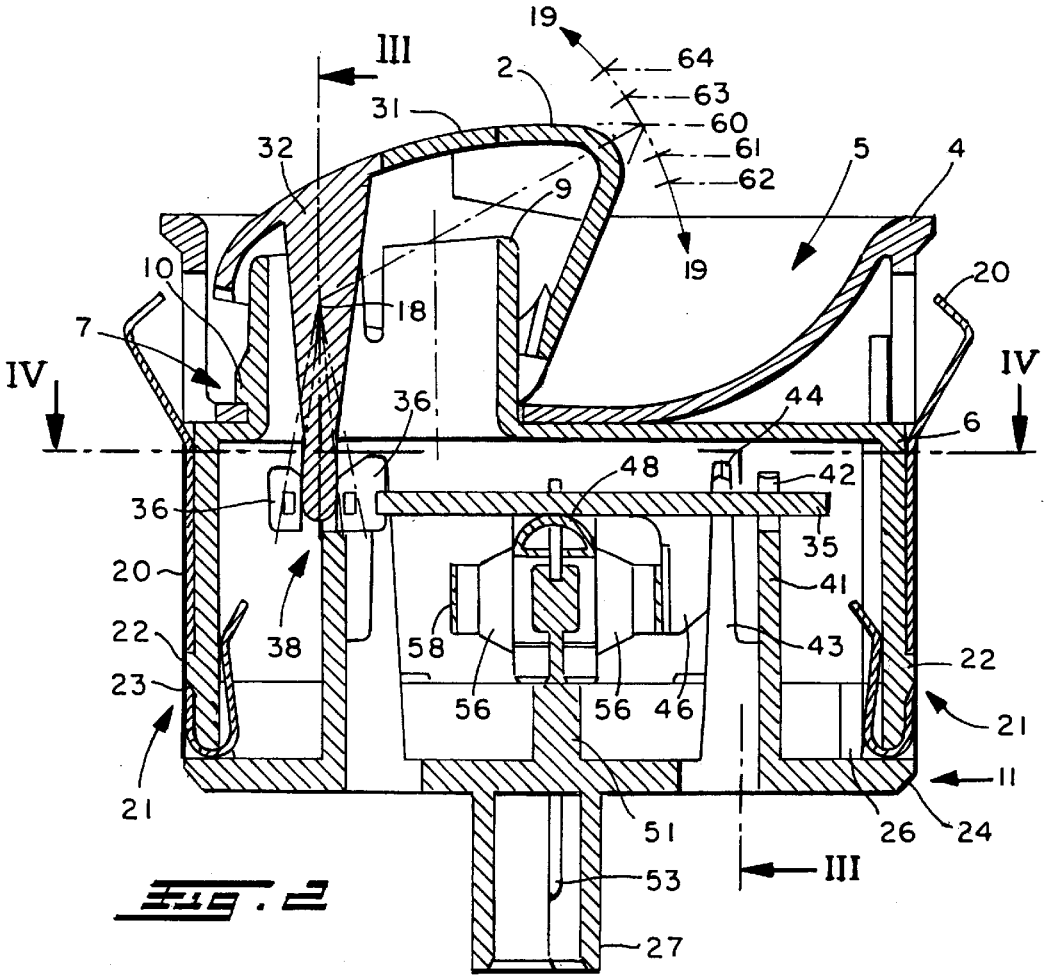
FIG. 2 is a sectional view of the power window switch of FIG. 1 along line II—II.
Figure 3:
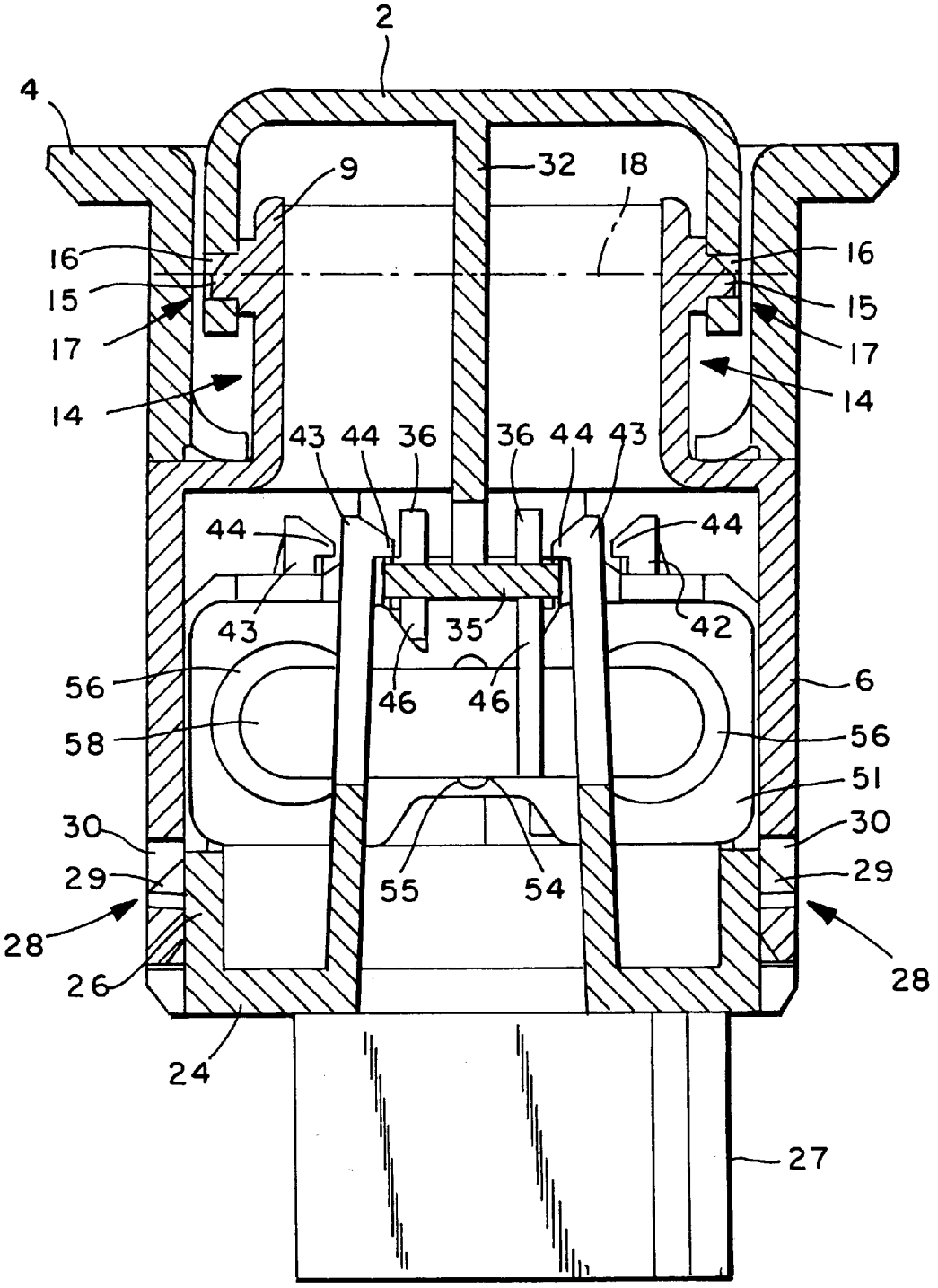
FIG. 3 is a sectional view of FIG. 2 along line III—III.
Figure 4:
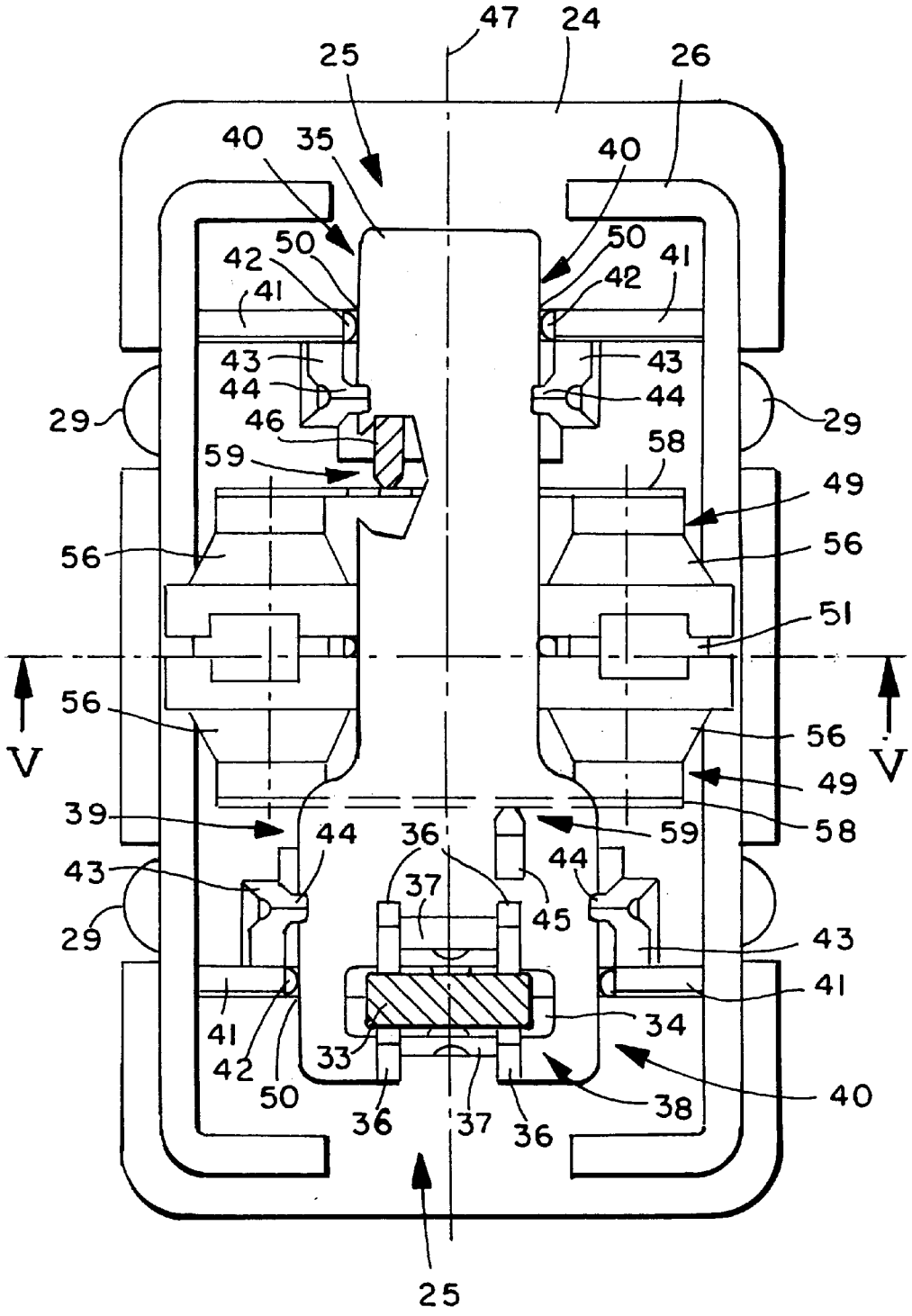
FIG. 4 is a sectional view of FIG. 2 along line IV—IV.
Figure 5:
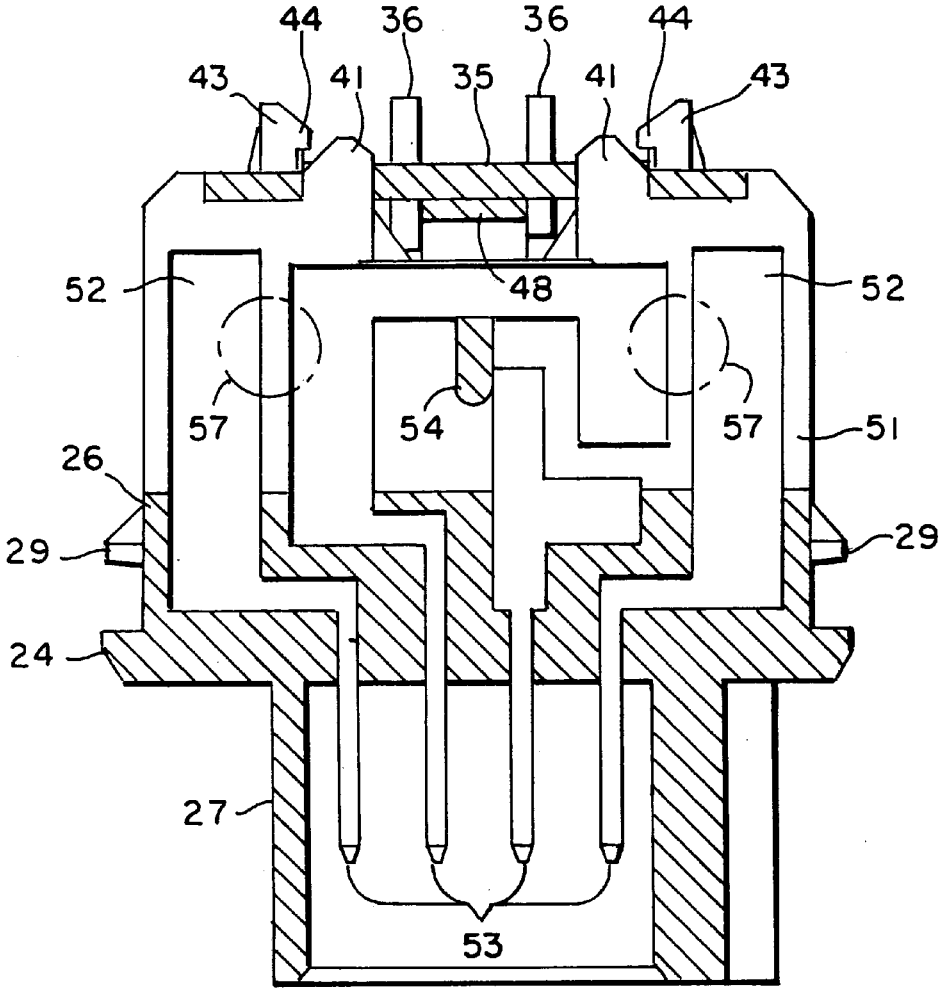
FIG. 5 is a sectional view of FIG. 4 along line V—V.
Figure 6:
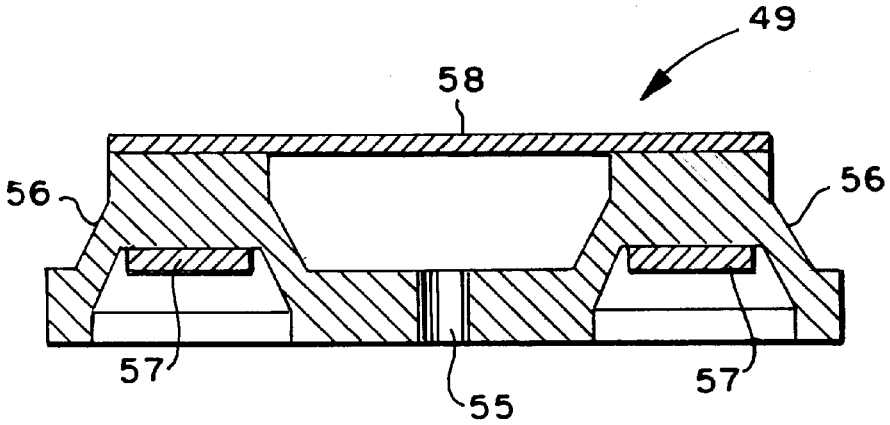
FIG. 6 is a sectional view of a switch matrix.
Figure 7:
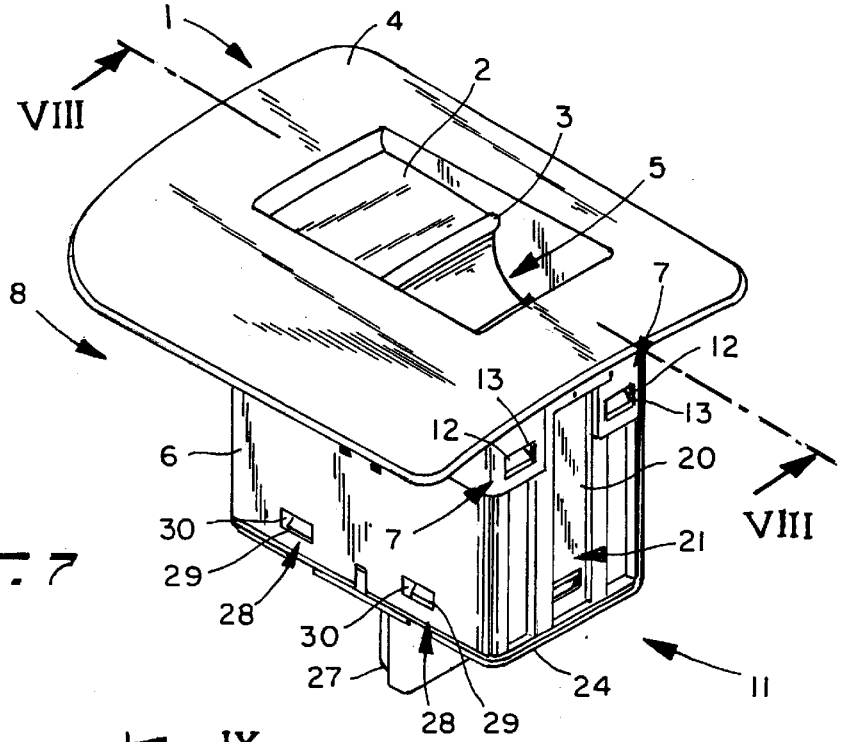
FIG. 7 is a perspective view of an alternative form of embodiment of the inventive power window switch.
Figure 8:
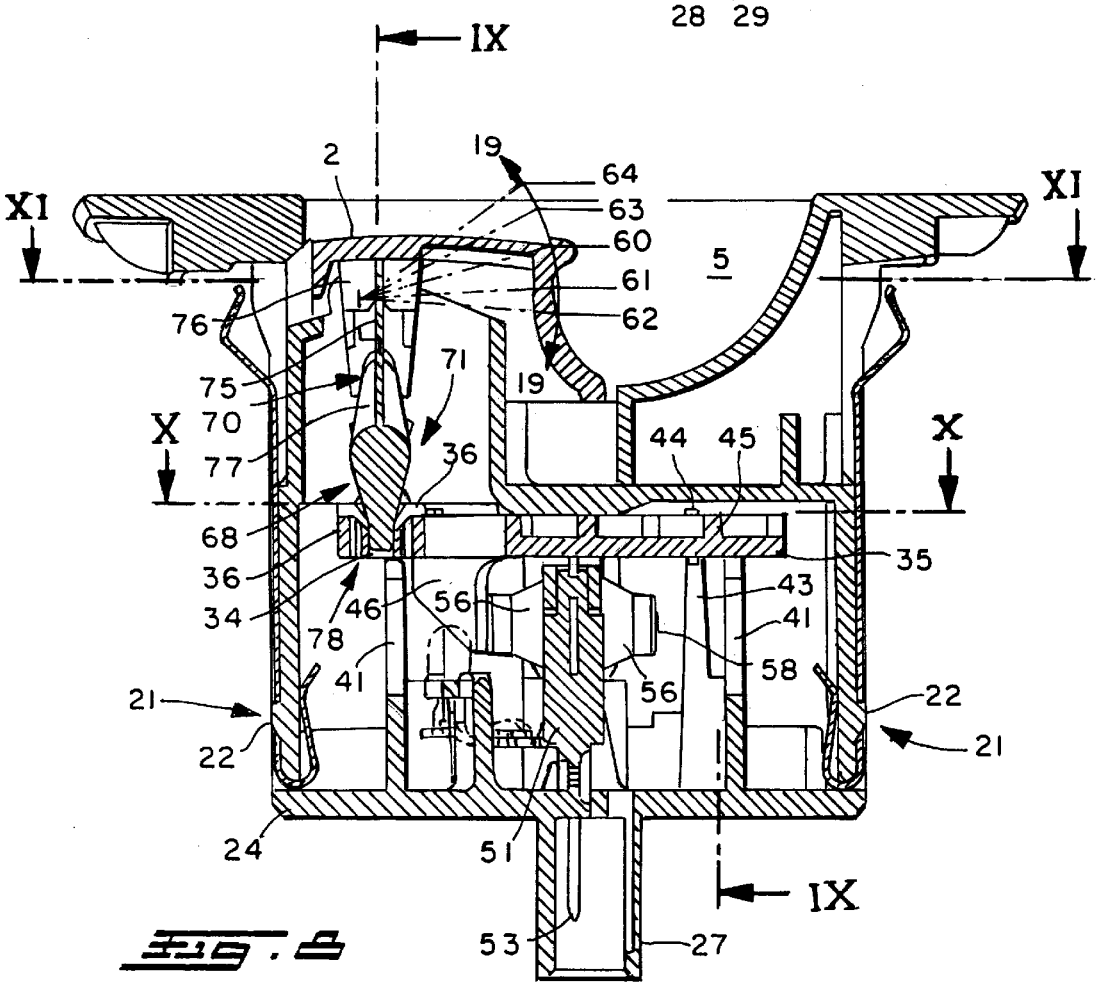
FIG. 8 is a sectional view of FIG. 7 along line VIII—VIII.
Figure 9:
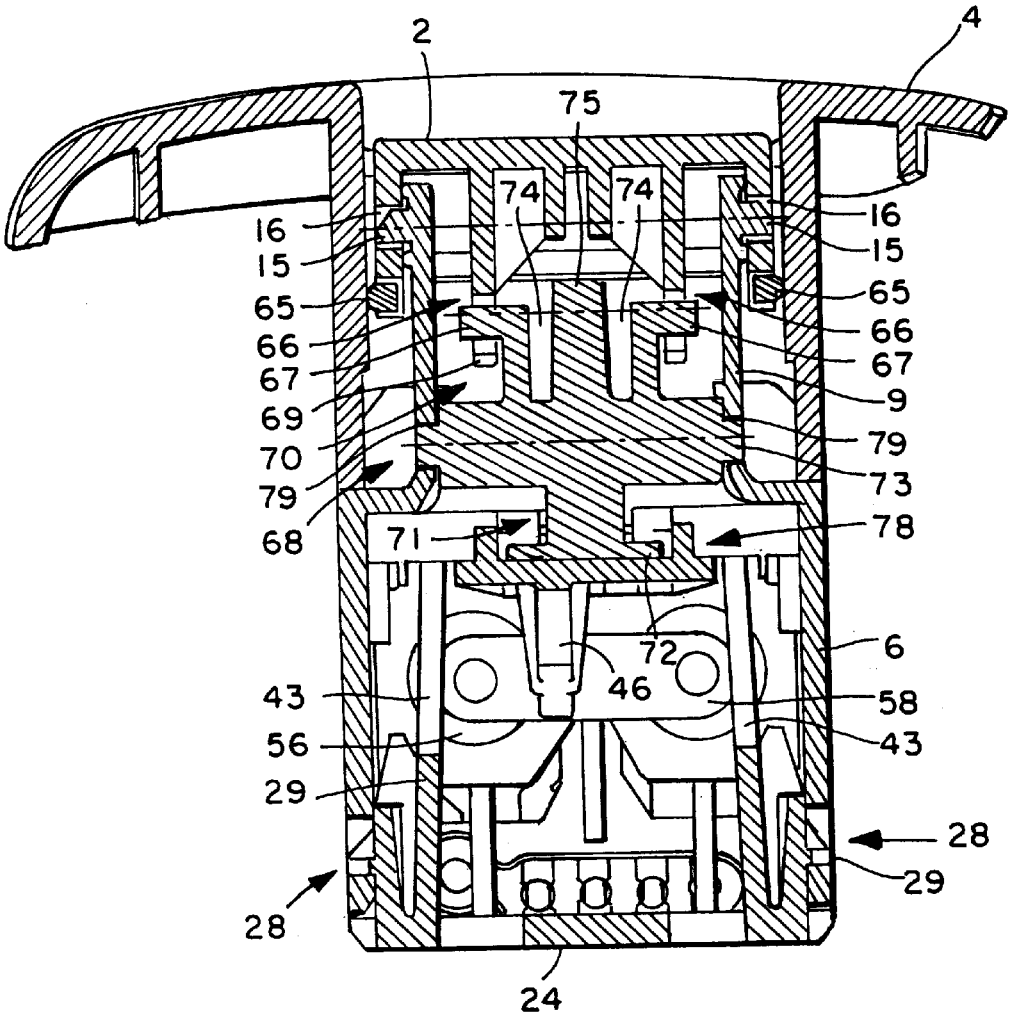
FIG. 9 is a sectional view of FIG. 8 along line IX—IX.
Figure 10:
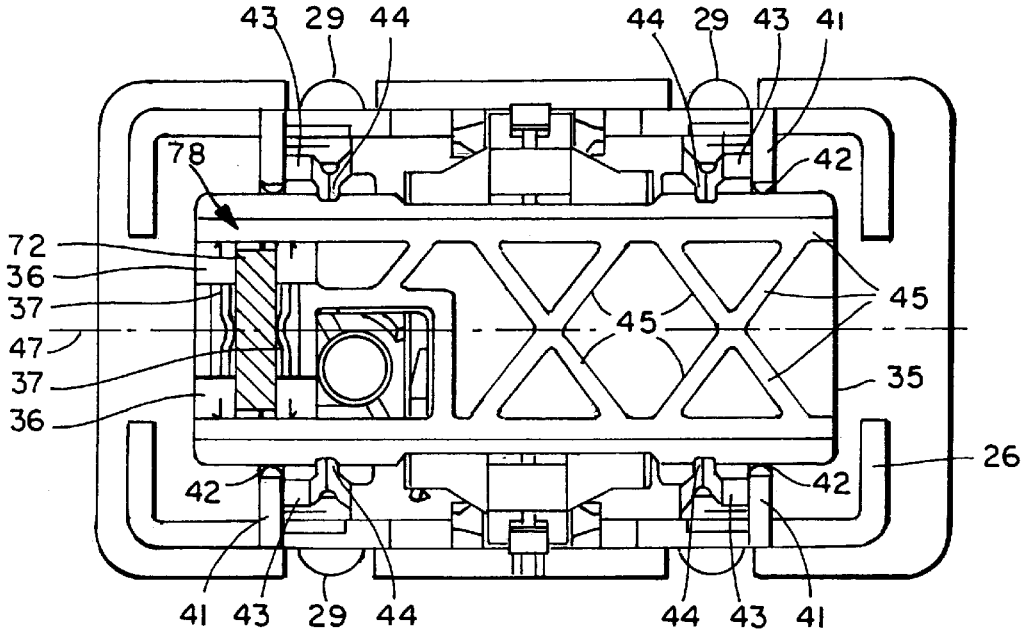
FIG. 10 is a view of FIG. 8 along line X—X.
Figure 11:
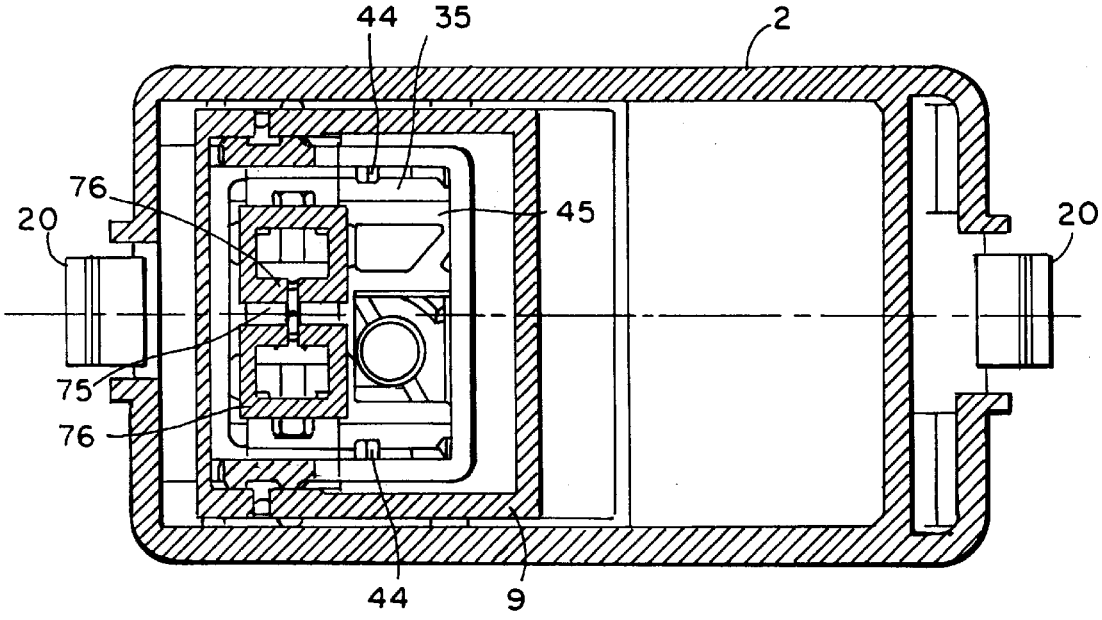
FIG. 11 is a sectional view of FIG. 8 along line XI—XI.

Referring to FIGS. 1 through 3, a central retaining spring 20, which has a U-shaped lower portion such that it extends around housing 6, is provided on front side 8 and on rear side 11 of housing 6. Retaining springs 20 are fastened by clip connections indicated generally at 21, whereby housing 6 has on its front side 8 and its rear side 11 one clip nose or projection 22 each, the clip noses coming into engagement with a corresponding clip opening 23 of retaining spring 20. It will be understood that retaining springs 20 are used for the installation of power window switch 1 in a not illustrated installation opening of a motor vehicle. Housing 6 is associated with a base 24 having molded to its upper side a sidewall or collar 26, which can be inserted in housing 6 and which has cutouts indicated generally at 25 in the area of front side 8 and rear side 11 (see FIG. 4). Cutouts 25 serve as spaces for retaining springs 20 located in this area. A connector collar 27 (see FIG. 5) is located on the lower side of base 24. Lateral clip connections 28 are used for mounting base 24 to housing 6. In order to achieve clip connections 28, collar 26 of base 24 has on each longitudinal side two clip noses or projections 29 at a distance from each other, and which come into engagement with corresponding clip openings 30 of housing 6.

On its upper rounded side, actuation element 2 has symbols or translucent lenses 31, which may be backlit by not illustrated light-emitting elements. A crosspiece 32, tapering in thickness in a downward direction, is molded centrally to the lower side of actuation element 2 and in alignment with circular clip openings 16. The width of crosspiece 32 is constant with the exception of its free end 33 (see FIG. 4). Free end 33 of crosspiece 32 is T-shaped, whereby opposing sides have a circular or semi-circular cross section, and comes into engagement with a rectangular opening 34 of a sliding contact element 35 accommodated in housing 6.

Each of the longitudinal sides of opening 34 is provided with two opposing reinforcing ribs 36 projecting slightly beyond opening 34 and accommodating between them T-shaped end 33 of crosspiece 32. In order to compensate for the existing play between reinforcing ribs 36 and T-shaped end 33 of crosspiece 32, each longitudinal side of opening 34 has, between reinforcing ribs 36, a pre-tensioned spring arm 37 abutting against T-shaped end 33 of crosspiece 32. In this embodiment, free end 33 of crosspiece 32 and opening 34 of sliding contact element 35 form a deflecting means indicated generally at 38.

Sliding contact element 35 has essentially the shape of a plate with constant thickness and has a wider portion indicated generally at 39 in the area of opening 34. All longitudinal sides 40 of sliding contact element 35 run parallel with respect each other. Sliding contact element 35 is guided horizontally between stationary, opposing pairs of guide bars 41 of base 24.

In the area, in which guide bars 41 abut against the longitudinal sides of sliding contact element 35, the guide bars' front sides each have a radius 42. The vertical limit of movement of sliding contact element 35 in the upward direction is represented by pairs of opposing clip arms 43 of base 24, whereby their clip noses 44 are associated with the upper side of sliding contact element 35 in such a manner that they have play. If the upper side of the sliding contact element is provided with reinforcing ribs 45, the clip noses extend around sliding contact element 35 in edge areas without reinforcing ribs 45. As a result of this, the horizontal mobility of sliding contact element 35 in the required range is ensured. The lower side of sliding contact element 35 has two actuation extensions 46, which are provided off-center with respect to longitudinal axis 47 of sliding contact element 35, and at a distance from each other. Vertical movement of sliding contact element 35 in the downward direction is limited by a flexible connecting bracket 48 of two switch matrices 49 and by sections 50 in the upper area of guide bars 41, thereby effecting a vertical compensation of play.

The two switch matrices 49 coupled by connecting bracket 48 are located opposite each other. Between switch matrices 49, base 24 has an adjoining rib 51 in perpendicular alignment with the longitudinal axis of sliding contact element 35, the rib 51 being extruded in a punch grid 52. Connector contacts 53 of punch grid 52 extend into connector collar 27 of base 24. On each side of rib 51 is a central crosspiece 54, which comes into engagement with a slot-shaped opening 55 of corresponding switch matrix 49, thereby fixing said matrix in place. Each switch matrix 49 has two adjacent domes 56 arranged at a distance from each other, whereby each dome 56 accommodates one switch contact indicated generally at 57. The two domes 56 of each switch matrix 49 are covered in their upper area by one actuation plate 58. The two switch matrices 49 and their corresponding actuation plates 58 are positioned between actuation extensions 46 of sliding contact element 35, at right angles with respect to said sliding contact element's longitudinal axis. Each actuation extension 46 has a V-shaped tip indicated generally at 59 in its area of contact with actuation plate 58.

When actuation element 2 of power window switch 1 is moved out of its zero position 60 in pushing direction into a first-stage 61 switch position, a counterclockwise pivoting motion of crosspiece 32 about axis of rotation 18 occurs. T-shaped end 33 of crosspiece 32 coming into engagement with opening 34 of sliding contact element 35 and retained by reinforcing ribs 36, as well as by spring arms 37, transmits this counterclockwise motion to sliding contact element 35. Deflecting means 38 converts the rotary motion of crosspiece 32 into a translation motion of sliding contact element 35, i.e., following the direction of movement of crosspiece 32. Actuation extension 46 on the right begins to act on actuation plate 58 of switch matrix 49 on the right. Due to the arrangement of the actuation extension 46 outside longitudinal axis 47 of sliding contact element 35 and the resultant lever ratios, the greatest torque acts on dome 56 near actuation extension 46 so that said dome collapses and the corresponding switch contact 57 closes an electric circuit on punch grid 52. The collapse of dome 56 and appropriate design measures permit the recognition of the switch setting by touch. In this first-stage 61 switch setting a not illustrated power window motor is energized in such a manner that a not illustrated motor vehicle window is slowly moved in downward direction. When actuation element 2 is released, dome 56 pops back into its home position. The electric circuit is opened and the motor vehicle window stops in the attained position. Due to the resetting effect of dome 56, sliding contact element 35 and actuation element 2 are reset into their zero position 60. If actuation element 2 of switch 1 is pivoted out of zero position 60 in pushing direction into a second-stage 62 switch setting, the already described motion cycles follow. Actuation extension 46 on the right begins to act on actuation plate 58 of switch matrix 49 on the right and causes dome 56 closest to said actuation extension to collapse due to the torque acting on said dome. The corresponding switch contact 57 closes an electric circuit on punch grid 52. Inasmuch as the second-stage 62 switch setting causes sliding contact element 35 to carry out a greater movement to the left than the first-stage 61 switch setting, second dome 56 located at a greater distance from actuation extension 46 begins to collapse after the first electric circuit has been closed. Switch contact 57 associated with said latter dome closes an additional electric circuit on punch grid 52. Also, the switch operation of second dome 56 can be felt by touch. The power window motor, which has been energized in this manner, rapidly moves the motor vehicle window downward into its end position. Actuation element 2 is reset after said element is released due to the forces generated by the popping back of dome 56.

In order to move the motor vehicle window up, the pivoting motion 19 of actuation element 2 occurs in pulling direction, i.e., in first-stage 63 and/or second-stage 64 switch settings. The motion cycles for activating switch matrix 49 on the right are equivalent to those, which have already been described, however, in the opposite direction.

Referring to FIGS. 6–11 In an alternative form of power window switch 1, is illustrated having an actuation element 2 which is recessed into well 5 of shield 4 in such a manner that upper edge 3 does not extend beyond shield 4. Underneath axis of rotation 18 represented by clip connections 17, about which actuation element 2 carries out pivoting motion 19, a peripheral gasket 65 is provided and which abuts against shield 4 to prevent dirt from entering the inside of the switch.

Two opposing forks indicated generally at 66 are molded at a distance from each other to actuation element 2, whereby said forks extend around horizontal pins 67 of a deflecting lever indicated generally at 68 pivotally mounted in housing 6. In order to facilitate assembly, the free ends of forks 66 are provided with insertion tapers 69 for pins 67.

Deflecting lever 68 has two arms, whereby one arm indicated generally at 70 has pins 67 and the other arm indicated generally at 71 has a T-shaped end 72 having a circular or semi-circular cross-section and coming into engagement with opening 34 of sliding contact element 35. Deflecting lever 68 performs its pivoting motion by means of two horizontally opposing support pins 73, which come into engagement with corresponding openings 79 of collar 9 of housing 6. The cross-section of deflecting lever 68 is larger in the area of support pins 73. Arm 70 of deflecting lever 68 supporting pin 67 is provided on its front end with a cutout 74, thereby dividing arm 70. The base of cutout 74 has an adjoining resilient tongue 75, which is retained on its end-side by actuation element 2 in such a manner that there is no play. To accomplish this, actuation element 2 has appropriately configured integrally molded sections 76. In order to reinforce arm 70, opposing reinforcing ribs 77 are provided.

In this alternative embodiment, the deflecting means indicated generally at 78 consists of deflecting lever 68 and opening 34 of sliding contact element 35.

During the pivoting motion 19 of actuation element 2 of power window switch 1 out of the zero position 60 in a pushing direction into a first-stage 61 switch setting, T-shaped end 72 of deflecting lever 68 performs a clockwise pivoting motion against the spring force of tongue 75, and switch sliding element 35 follows. The re-direction of the rotary motion of deflecting lever 68 into a translation motion of the sliding contact element is accomplished by deflecting means 78. Actuation extension 46 on the left begins to act on actuation plate 58 of switch matrix 49 on the left. As already mentioned, an electric circuit on punch grid 52 is closed by corresponding switch contact 57 in collapsing dome 56, whereby the configuration of dome 56 permits the recognition of the switch setting by touch. Due to the corresponding energization of connector contacts 53, in a motor vehicle power window application, the window is opened slowly. When actuation element 2 is released, dome 56 pops back into its home position. The electric circuit is opened and the motor vehicle window stops in the reached position. Due to the resetting effect of dome 56 and the supporting action of pre-tensioned tongue 75, sliding contact element 35 and actuation element 2 are moved into zero position 60. In the second-stage 62 switch setting in a pushing direction, another electric circuit on punch grid 52 is closed as described above; and, the motor vehicle window opens very rapidly until it has reached its end position.

In order to close the motor vehicle window, actuation element 2 is pivoted in a pulling direction into first-stage 63 and/or second-stage 64 switch settings. Subsequent motion cycles for the actuation of switch matrix 49 take place in the same manner as described, however, of course, in the opposite direction.

Although the invention has hereinabove been described with respect to the illustrated embodiments, it will be understood that the invention is capable of modification and variation and is limited only by the following claims.

What is claimed is:

1. A switch for selectively energizing a vehicle power window lifting and lowering motor comprising:

(a) a housing having an actuation element pivotally supported thereon;

(b) a slider contact element disposed for sliding movement on said housing, said slider contact element associated with a plurality of connector contacts;

(c) a switch matrix disposed on said housing and having a plurality of actuatable contacts associated therewith;

(d) deflecting means comprising a lever pivoted on said housing and acted on by said actuation element;

(e) said actuation element operable upon user pivoting in one direction for effecting said sliding movement of said slider contact element in a forward direction for closing of said connector contacts with certain of said actuatable contacts for energizing the motor for window lift, said actuation element operable upon user pivoting in a direction opposite said one direction for effecting said sliding movement of said slider contact element in a direction opposite said forward direction and closing of said connector contacts with others of said actuatable contacts for energizing the motor for window lowering, wherein said deflecting means acts on said slider contact element to effect said forward and opposite direction movement and actuates two of said actuatable contacts successively in each of said forward and opposite directions.

2. The switch defined in claim 1, wherein said user pivoting of said actuator element in said one direction comprises user pulling on a portion of said actuator element and said user pivoting in said direction opposite comprises user pushing.

3. The switch defined in claim 1, wherein said actuatable contacts are located in collapsible domes.

* * * * *